United States Patent [19]

Roth et al.

[11] Patent Number: 4,834,903

[45] Date of Patent: May 30, 1989

[54] ALKYLENE OXIDE ADDUCTS OF GLYCOSIDE SURFACTANTS AND DETERGENT COMPOSITIONS CONTAINING SAME

[75] Inventors: Claris D. Roth; Kenneth B. Moser; Gail M. Howell; Allen D. Urfer, all of Decatur, Ill.

[73] Assignee: Henkel Corporation, Ambler, Pa.

[21] Appl. No.: 203,604

[22] Filed: Jun. 2, 1988

Related U.S. Application Data

[63] Continuation of Ser. No. 923,789, Sep. 29, 1986, abandoned.

[51] Int. Cl.[4] ..... C11D 3/22

[52] U.S. Cl. ..... 252/174.17; 252/173; 252/351; 252/DIG. 14; 536/18.3; 536/120

[58] Field of Search ..... 252/174.17, 89.1, 173, 252/DIG. 14, 351; 536/18.3, 120

[56] References Cited

U.S. PATENT DOCUMENTS

| | | | |
|---|---|---|---|
| 2,356,565 | 8/1944 | Chwala | 260/210 |
| 3,073,788 | 1/1963 | Hostettler et al. | 260/2.5 |
| 3,640,998 | 2/1972 | Mansfield et al. | 252/351 |
| 3,737,426 | 6/1973 | Throckmorton et al. | 252/174.17 |
| 4,450,090 | 5/1984 | Kinney | 252/106 |
| 4,483,779 | 11/1984 | Llenado et al. | 252/174.17 |
| 4,528,106 | 7/1985 | Grolitzer | 252/8.55 |
| 4,627,931 | 12/1986 | Malik | 252/174.17 |
| 4,675,127 | 6/1987 | Kickle et al. | 252/174.17 |
| 4,683,074 | 6/1987 | Malik et al. | 252/136 |
| 4,732,704 | 3/1988 | Biermann et al. | 252/174.17 |

FOREIGN PATENT DOCUMENTS 1009030 11/1965 United Kingdom .

OTHER PUBLICATIONS

Standard Test Method for Foaming Properties of Surface-Active Agents, American National Standard 1980, pp. 184–186.

Standard Method for Evaluation of Wetting Agents by the Skein Test, American National Standad 1979, pp. 334–338.

*Primary Examiner*—Paul Lieberman

*Assistant Examiner*—Hoa Van Le

*Attorney, Agent, or Firm*—Michael F. Campbell; Ernest G. Szoke; Wayne C. Jaeschke

[57] ABSTRACT

Remarkably good surfactancy characteristics are exhibited by alkylene oxide (e.g., ethylene oxide, propylene oxide, etc.) adducts of relatively low degree of polymerication, (D.P.), long chain glycoside compositions of the sort which are predominantly composed of long chain monoglycoside species and in which the types and relative proportions of any long chain polyglycoside species contained therein are such that the average degree of polymerization of such long chain glycoside constituents is less than 2.7.

The subject low D.P. long chain polyglycoside alkylene oxide adducts exhibit surfactancy and/or detergency characteristics at least about as good as, and in some respects substantially better than, the corresponding alkylene oxide adducts of higher D.P. long chain glycoside materials.

33 Claims, No Drawings

ALKYLENE OXIDE ADDUCTS OF GLYCOSIDE SURFACTANTS AND DETERGENT COMPOSITIONS CONTAINING SAME

BACKGROUND OF THE INVENTION

Cross Reference To Related Application

This is a continuation of copending application Ser. No. 06/923,789 which was filed on Sept. 9, 1986 now abandoned.

This invention relates generally to materials which are useful as nonionic surfactants and, in particular, to alkylene oxide adducts of certain long chain glycosides and to the use of same in formulated detergent compositions.

Long chain glycosides have long been known as materials which can function in detergent products. The long chain glycosides are nonionic surfactants which are prepared through the reaction of a saccharide material and a long chain alcohol. The alcohol portion of the molecule adds hydrophobic character whereas the saccharide portion of the molecule increases the water solubility. A measure of the degree of the water solubility can be obtained through a measurement known as the degree of polymerization of the glycoside. The degree of polymerization (or D.P.) is conveniently measured as the average number of saccharide molecules which have been joined together in forming the glycoside.

Mansfield et al in U.S. Pat. No. 3,640,998 issued Feb. 8, 1972 describes alkyl oligosaccharide compositions in which the oligosaccharide component has an average D.P. of at least 3 and which have been reacted with ethylene oxide or propylene oxide. The apparent purpose in the Mansfield et al patent for so treating the glycoside surfactant is to convert the residual fatty alcohol which was used in obtaining the alkyl oligosaccharide to an alkoxylated alcohol. The alkoxylated alcohols are well known as nonionic surfactants. In the absence of treating the alcohol to form an alkoxylated alcohol, Mansfield was left with a large portion of unreacted fatty alcohol in the reaction mixture as well as large amounts of lower (non-surfactant) glycosides. The presence of unreacted fatty alcohol inhibits the cleaning ability of the composition. Additionally, the presence of lower glycosides diminishes the capacity of the composition to clean effectively.

The use of glycosides in detergent compositions is disclosed in U.S. Pat. No. 4,483,779 issued Nov. 20, 1984 to Llenado et al. The Llenado et al patent shows an unmodified glycoside surfactant in combination with other nonionic detergents including ethoxylated alcohols.

The preparation of glycosides containing alkoxy groups between the fatty residue and the saccharide portions of the glycoside molecule are described in U.S. Pat. No. 3,219,656 to Boettner issued Nov. 23, 1965. Alkyl polyglycosides are described in U.S. Pat. No. 3,598,865 issued Aug. 10, 1971 to Lew.

Glycosides containing ethylene glycol residues are described in U.S. Pat. No. 3,737,426 issued June 5, 1973 to Throckmorton et al. The reader is also referred to *Tenside Detergents;* January/February 1973; New Biodegradable Surfactants Derived from Starch: Preparation and Properties; Throckmorton et al.

It has now been found that the benefits of alkoxylation are particularly pronounced for long chain glycoside compositions containing relatively large amounts of long chain monoglycoside constituents and for those compositions wherein long chain polyglycoside constituents contained therein have an overall polyglycoside average D.P. of less than 2.7. In particular, it has been found that alkxoylated glycoside surfactants need not (and for some purposes should not) be highly polymerized with regard to the saccharide portion of the molecule in order to obtain desired surfactancy and/or detergency characteristics.

Throughout the specification and claims percentages and ratios are by weight, temperatures are in degrees Celsius and pressures are in KPascals over ambient unless otherwise indicated. The references cited in this patent are to the extent applicable herein incorporated by reference.

SUMMARY OF THE INVENTION

In one aspect, the present invention is an oxyalkylated long chain glycoside composition which comprises, on a total oxyalkylated long chain glycoside weight basis:

(a) from about 50 to 100 weight percent of an oxyalkylated long chain monoglycoside of the formula:

$$R—O—G\ (AO)_mH \qquad A;$$

(b) from 0 to about 50 weight percent of a oxyalkylated long chain polyglycoside of the formula:

$$R—O\ (G)_x(AO)_nH \qquad B$$

wherein R is a monovalent hydrocarbon radical containing from about 6 to about 20 carbon atoms; G is a moiety derived from a reducing saccharide containing 5 or 6 carbon atoms; AO is an alkylene oxide residue; m represents the degree of alkylene oxide substitution on the oxyalkylated long chain monoglycoside and has an average value of from 1 to about 10; n represents the degree of alkylene oxide substitution on the oxyalkylated long chain polyglycoside and has an average value of from 1 to about 30; x represents the number of monosaccharide repeating units in the oxyalkylated long chain polyglycoside, is an integer of 2 or greater on a molecule by molecule basis and has an average value (taken over all oxyalkylated long chain polyglycoside molecules in the compositions) of less than 2.7.

In another aspect, the present invention is a formulated detergent composition in which the above-described oxyalkylated long chain glycoside composition is utilized in combination with one or more anionic, cationic or nonionic cosurfactant ingredients and/or with one or more detergent builder components. Typically the indicated oxyalkylated long chain glycoside composition will constitute from about 1 to about 90 weight percent of the detergent composition; the cosurfactant ingredient, if used, will constitue from about 1 to about 90 weight percent of such composition; the builder component, if used, will constitute from about 1 to about 90 weight percent of said composition; and water may, if desired, be included at levels of up to about 98 weight percent.

The above-described oxyalkylated long chain glycoside materials, and the formulated detergent compositions comprising same, exhibit notably improved or enhanced surface active properties and/or detergency effectiveness when compared against comparable compositions or formulations utilizing their corresponding non-oxyalkylated counterparts.

In one particularly preferred embodiment of the invention, the oxyalkylated long chain glycoside composition comprises an average of from about 1 to about 5 (preferably from about 1 to about 4 and especially from about 1 to about 3) moles of alkylene oxide substitution per mole of monosaccharide repeat units within the oxyalkylated long chain mono- and polyglycoside constituents within said composition. Among such preferred compositions, those which have been provided with from about 1 to about 3.5 (especially from about 1 to about 2) moles of alkylene oxide substitution per mole of monosaccharide repeat units are uniquely characterized as having very rapid wetting properties as determined, for example, by Draves Sink Time testing.

The indicated preferred compositions containing from about 1 to about 5 moles of alkylene oxide substitution per mole of monosaccharide repeat units have, when compared against their non-oxyalkylated counterparts, dramatically enhanced foaming characteristics (as determined, for example, by Ross Miels Foam Height testing) and substantially improved laundry cleaning effectiveness. These latter features or benefits are generally maximized at alkylene oxide substitution levels of from about 2 to about 5 moles thereof per mole of monosaccharide repeat unit and, as a result, oxyalkylated glycoside materials having those levels of alkylene oxide substitution (and formulated compositions containing same) are of special interest for the purpose of the present invention.

DETAILED DESCRIPTION OF THE INVENTION

As has been noted, the oxyalkylated long chain glycoside compositions of the present invention generally comprise, on a total oxyalkylated long chain glycoside component weight basis, from about 50 to 100 weight percent of long chain oxyalkylated monoglycoside molecules of the formula A above and from 0 to about 50 weight percent of long chain oxyalkylated polyglycosides of the formula B above.

Preferably, the formula A monoglycoside species constitute from about 55 to about 96 (more preferably from about 60 to about 90 and most preferably from about 65 to about 85) weight percent of the long chain oxyalkylated glycoside ingredients and the formula B polyglycoside species preferably constitutes from about 5 to about 45 (more preferably from about 10 to about 40 and most preferably from about 15 to about 35 weight percent thereof.

The overall average degree of polymerization (D.P.), of the long chain oxyalkylated composition of the invention (i.e., taken over all long chain oxyalkylated mono- and polyglycoside species within such composition) is of necessity always about 1.85 or less since at least about 50 weight percent of such composition is composed of monoglycoside species and since the remainder thereof (i.e., about 50 weight percent, at most) is composed of polyglycoside species which, taken together or as a whole, have a polyglycoside average D.P. of less than 2.7. Preferably, the overall average D.P. of the subject long chain oxyalkylated glycoside compositions hereof is less than 1.7, more preferably less than 1.6 and most preferably less than 1.5.

In the monoglycoside and polyglycoside species of the formulas A and B, respectively, the reducing saccharide-derived moiety, G, can suitably originate from any 5 or 6-carbon reducing saccharide, specific examples of which include glucose, fructose, mannose, galactose, talose, gulose, allose, altrose, idose, arabinose, xylose, lyxose and ribose. Of these, long chain oxyalkylated glucoside compositions wherein the moiety, G, is derived from glucose are of particular interest.

The hydrophobic group, R, in the formulas A and B above is a monovalent hydrocarbon radical and typically contains from about 6 to about 20 carbon atoms. In certain preferred embodiments, the monovalent hydrocarbon group, R, contains from about 8 to about 18, more preferably from about 10 to about 18 and most preferably from about 12 to about 18, carbon atoms. The R group is preferably an alkyl group, although alkenyl groups may also be employed. Similarly, R may be a group which contains an aromatic group such as, for example, an alkylphenyl, phenylalkyl, alkylbenzyl, and the like.

The group —AO— in the formulas A and B above is an oxyalkyl group which represents the residue of an alkylene oxide material which has been reacted with a starting material composed of non-oxyalkylated mixture of mono- and polyglycosides to form the oxyalkylated glycoside compositions of interest. Preferably the alkylene oxide employed is ethylene oxide, propylene oxide or mixtures thereof.

As a general rule, the compositions hereof have been oxyalkylated to an extent sufficient to provide an average of from about 1 to about 10 (preferably from about 1 to about 5) moles of alkylene oxide substitution per mole of monosaccharide repeat units within the oxyalkylated long chain mono- and polyglycoside constituents within the subject compositions. As such, the subscript "m" in the formula A above generally has an average value of from about 1 to about 10 (preferably from about 1 to about 5) and the subscript "n" in formula B typically has an average value of from about 1 to about 30 (preferably from about 1 to about 15).

The subscript "x" in formula B above represents the number of monosaccharide repeating units in the oxyalkylated long chain polyglycoside and, on a molecule by molecule basis, is an integer of 2 or more. As an average taken over all formula B molecules within the subject composition, x has an average value of less than 2.7, preferably less than 2.6, more preferably less than 2.5, even more preferably less than 2.4 and most preferably less than 2.3.

The oxyalkylated glycoside compositions of the present invention are conveniently prepared by reacting alkylene oxide (typically ethylene oxide, propylene oxide or mixtures thereof and, most preferably, ethylene oxide) with a non-oxyalkylated starting material containing a mixture of long chain monoglycosides and long chain polyglycosides which corresponds, in terms of its relative proportions of long chain monoglycoside and long chain polyglycoside constituents and in terms of the average DP of the long chain polyglycoside constituents, to that which is desired for the oxyalkylated glycoside composition of interest. The amount of alkylene oxide employed in the reaction will naturally depend upon the degree of oxyalkylation which is desired for the oxyalkylated long chain glycoside reaction product of interest. As a general rule, however, from about 5 to about 250 (preferably about 10 to about 50) parts by weight of alkylene oxide will be employed per 100 parts by weight of non-oxyalkylated long chain glycoside starting material.

The non-oxyalkylated starting material itself may be conveniently prepared by first reacting a lower alkanol such as methanol, ethanol, propanol, butanol, etc. with a saccharide raw material (e.g., starch, dextrose, fructose, etc.) in the presence of an acid catalyst to form a lower (e.g., $C_1$–$C_4$) alkyl glycoside product and subsequently reacting said lower alkyl glycoside with the desired $C_6$–$C_{20}$ long chain alcohol in the presence of an acid catalyst to form the non-oxyalkylated long chain glycoside starting material. Advantageously, the resulting non-oxyalkylated long chain glycoside starting material contains less than 20 (preferably less than 15, more preferably less than 10 and most preferably less than 5) weight percent of residual lower alkyl glycoside intermediate reaction product. Similarly, the ultimately desired oxyalkylated long chain glycoside product of interest will generally contain less than 20 (preferably less than 15, more preferably less than 10 and most preferably less than 5) weight percent (on an oxyalkylated long chain glycoside weight basis) of oxyalkylated lower alkyl glycoside following the hereinafter-described alkylene oxide reaction.

The reaction of the indicated non-oxyalkylated long chain glycoside starting materials with the above-described alkylene oxide reactant is preferably conducted at an elevated temperature (e.g., from about 120° to about 170° C.) and with the aid of a base catalyst such as, for example, sodium hydroxide, sodium carbonate, sodium methoxide, and the like. Preferably such reaction is conducted under substantially anhydrous conditions such that water, if present at all, does not exceed more than 5 (and is preferably less than 1) weight percent of the total reaction mixture.

As has been noted, one aspect of the present invention resides in formulated detergent compositions in which the above-described oxyalkylated long chain glycoside compositions are used in combination with one or more anionic, cationic or nonionic cosurfactant ingredients and/or with one or more conventional detergent builder ingredients.

Anionic cosurfactants suitable for use herein include sulfates, sulfonates, carboxylates and mixtures thereof. Such cosurfactants are typically neutralized with a cationic group such as an alkali metal (e.g. sodium or potassium), ammonium, substituted ammonium (including mono-, di-, or triethanolammonium cations), and the like. Mixtures of cations can be desirable. The anionic cosurfactants useful in the present invention all have detergent properties and are all water-soluble or dispersible in water.

One of the preferred anionic cosurfactants for use in this invention is alkylbenzene sulfonate. The alkyl group can be either saturated or unsaturated, branched or straight chain; is optionally substituted with a hydroxy group; typically contains a straight alkyl chain containing from about 9 to about 25 carbon atoms, preferably from about 10 to about 13 carbon atoms; and the cation is sodium, potassium, ammonium, mono-, di-, or triethanolammonium and mixtures thereof.

Other preferred anionic cosurfactants for use herein include carboxylates, e.g., fatty acid soaps and similar surfactants. The soaps can be saturated or unsaturated and can contain various substituents such as hydroxy groups and alpha-sulfonate groups. Preferably, the hydrophobic portion of the soap is a straight chain saturated or unsaturated hydrocarbon. The hydrophobic portion of the soap usually contains from about 6 to about 30 carbon atoms, preferably from about 10 to about 18 carbon atoms. The neutralizing cationic moiety of the carboxylate cosurfactant is selected from the group consisting of alkali metal, for example, sodium or potassium, ammonium, or substituted ammonium, including mono-, di-, or triethanolammonium cations. Mixtures of cations can be also be beneficially employed.

Other anionic cosurfactants which can be suitably employed herein include alkyl or alkenyl (i.e., paraffin or olefin) sulfonates containing from about 6 to about 30 carbon atoms. Preferred examples of these include $C_{14-15}$ paraffin sulfonates and $C_{14-16}$ olefin sulfonates.

Long chain (e.g., $C_{8-18}$) alkyl sulfates and polyether sulfates can also be beneficially employed as the anionic cosurfactant within the subject formulated detergent compositions.

Nonionic cosurfactants suitable for use herein include polyethylene oxide condensates of hydrophobic long chain alcohols such as $C_{6-12}$ alkyl phenols, $C_{8-18}$ aliphatic alcohols, and the like. Typically said cosurfactants contain an average of from about 3 to about 25 (preferably from about 5 to about 12) moles of condensed ethylene oxide repeating units per mole of hydrophobic alcohol.

Nonionic cosurfactants suitable for use herein also include non-oxyalkylated mixtures of long chain monoglycoside and long chain polyglycoside materials.

Suitable nonionic cosurfactants for use herein also include semi-polar nonionic detergent surfactants such as water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Cationic cosurfactants suitable for use herein include mono- and di-long chain quaternary ammonium surfactants which contain one or two long chain (e.g., $C_{12-22}$, especially $C_{12-18}$) hydrocarbon groups and two or three lower (e.g., $C_{1-4}$) alkyl and hydroxyalkyl substituents. Preferably the neutralizing anion of these cationic surfactants is a halide (e.g., chloride, bromide, etc.), hydroxide, sulfate, nitrate, phosphate or acetate anion.

Builder ingredients suitable for use herein are aluminosilicate materials, the various water-soluble alkali metal, ammonium or substituted ammonium phosphates, polyphosphates, phosphonates, polyphosphonates, carbonates, borates, silicates, polyhydroxysulfonates, polyacetates, carboxylates, polycarboxylates and the like.

Specific examples of inorganic phosphate builders suitable for use herein are sodium and potassium tripolyphosphate, pyrophosphate, polymeric metaphosphate having a degree of polymerization of from about 6 to 21, and orthophosphate. Examples of polyphosphonate builders include the sodium and potassium salts of ethylene-1, 1-diphosphonic acid, the sodium and potassium salts of ethane 1-hydroxy-1, 1-diphosphonic acid and the sodium and potassium salts of ethane, 1,1,2-triphosphonic acid.

Representative examples of nonphosphorus, inorganic builders include sodium and potassium carbonate, bicarbonate, sesquicarbonate, tetraborate decahydrate, and the various known silicate builder materials.

Exemplary of suitable polyacetate and polycarboxylate builders are the sodium, potassium, lithium, ammonium and substituted ammonium salts of ethylenediamine tetraacetic acid, nitrilotriacetic acid, oxydisuccinic acid, mellitic acid, benzene polycarboxylic acids, and citric acid as well as the water-soluble salts of homo- and copolymers of aliphatic carboxylic acids such as maleic acid, itaconic acid, mesaconic acid, fumaric acid, aconitic acid, citraconic acid and methylenemalonic acid.

Other builders suitable for use herein include sodium and potassium carboxymethyloxymalonate, carboxymethyloxysuccinate, cis-cyclo-hexanehexacarboxylate, cis-cyclopentanetetracarboxylate, phloro-glucinol trisulfonate, water-soluble polyacrylates (having molecular weights of from about 2,000 to about 200,000 for example), and the copolymers of maleic anhydride with vinyl methyl ether or ethylene.

Builder ingredients for use herein also include the glycerine/maleic anhydride (or maleic acid) reaction products described in Published European Patent Application No. 0150930. Such products generally corresponds to the formula $$R^1O—CH_2—CH(OR^2)—CH_2—OR^3$$

wherein at least one of $R^1$, $R^2$ or $R^3$ is a dicarboxylic group of the formula —CH(COOH)—$CH_2$—COOH and wherein the remainder of the $R^1$, $R^2$, or $R^3$ groups are either hydrogen or also correspond to the above-identified dicarboxylic acid group.

The aforementioned formulated detergent compositions can suitably take the form of substantially dry granular or powdered formulations or can, if desired, be prepared or formulated in the form of convenient-to-use liquid products.

When in powdered or granular form, such compositions will typically contain, on a total formulation weight basis, less than 30 (preferably less than 20) weight percent water; from about 1 to about 90 (preferably from about 5 to about 30) weight percent of above-described oxyalkylated long chain glycoside compositions; from about 0 to about 50 (preferably from about 10 to about 25) weight percent of a detergent builder component; and, optionally, up to about 50 (preferably from about 5 to about 30) weight percent of one or more of the above-described cosurfactant ingredients.

When prepared in liquid form, the subject detergent formulations will typically comprise, on a total formulation weight basis:

(a) from about 1 to about 90 (preferably from about 5 to about 30)weight percent of the above-described long chain oxyalkylated glycoside compositions;

(b) from about 20 to about 99 (preferably from about 35 to about 65) weight percent water;

(c) from 0 up to about 40 (preferably from about 5 to about 20) weight percent of a detergent builder ingredient; and (d) from 0 to about 40 (preferably from 5 to about 25) weight percent of an anionic, nonionic or cationic cosurfactant ingredient.

Additional ingredients which may also be included, if desired, in the subject formulated detergent compositions include those which are conventionally included for various diverse purposes in commercial detergent formulations. Examples of such additional ingredients include solvents, bleaching agents, bleach activators, soil-suspending agents, corrosion inhibitors, dyes, fillers, optical brighteners, germicides, pH adjusting agents (monoethanolamine, sodium carbonate, sodium hydroxide, etc.) enzymes, enzyme-stabilizing agents, perfumes, fabric softening components, static control agents, and the like.

The formulated detergent compositions hereof are suitably employed in a variety of diverse practical applications such as in laundry cleaning applications, in hard surface cleaning applications, as personal care products such as shampoos, bubble bath products, hand soap formulations, manual and automatic dishwashing compositions and the like.

The present invention is further illustrated and understood by reference to the following examples thereof.

EXAMPLE 1

A sealed reaction vessel of sufficient design to withstand 10,000 KPa pressure is evacuated and then charged with 307.5 parts of Product A which is 25.7% by weight dodecyl alcohol; 8.2% butyl glucoside; 66.1% dodecyl glucoside and 0.21% sodium methoxide. The dodecyl glucoside has an average D.P. of 1.4. Approximately 60–65 weight percent of the dodecyl glucoside component is dodecyl monoglucoside and approximately 35–40 weight percent of the dodecyl glucoside component is made up of dodecyl polyglucoside constituents. The average D.P. of the dodecyl polyglucoside constituents is less than 3.

Ethylene oxide is added to the reaction vessel to a pressure of 340 KPa. The reaction vessel is heated to 135° C. and maintained between 135° C. and 150° C. until 161 parts of ethylene oxide is taken up. The first run (B) is divided into 2 parts. One part is further reacted (to give Product C) by introducing 1.2 parts of additional sodium methoxide, repressurizing as was previously discussed and further adding of ethylene oxide at 140°–150° C. until an additional 172 parts of ethylene oxide is consumed. Product B contains about 5 moles of ethylene oxide per mole of glucoside while Product C contains 10 moles of ethylene oxide per mole of glucoside.

EXAMPLE II

The products of Example I are tested as shown below. The results show a product (B) made according to the invention to be superior in wetting ability to Product A the standard. Product C made according to the present invention is superior in foaming to Product A. Products B and C exhibit excellent cloud points when compared to Product A. The cleaning properties of Products B and C are observed to be superior to Product A in cleaning cotton/polyester and cotton fabrics.

TABLE I

| PRODUCT TESTED | SAMPLE A (NO EO) | SAMPLE B (5 MOLE EO) | SAMPLE C (10 MOLE EO) |
|---|---|---|---|
| Draves (Seconds) | 58 | 24 | 65 |
| Ross Miles Foam Height (0 min.) | 15 mm | 78 mm | 87 mm |
| Ross Miles Foam Height (5 min.) | 15 mm | 78 mm | 87 mm |
| Surface Tension (Dynes/cm) .01% | 32.4 | 30.9 | 31.6 |
| Surface Tension (Dynes/cm) | 26.8 | 30.8 | 27.2 |

TABLE I-continued

| PRODUCT TESTED | SAMPLE A (NO EO) | SAMPLE B (5 MOLE EO) | SAMPLE C (10 MOLE EO) |
|---|---|---|---|
| .10% Cloud Point (1% Solution) | Cloudy at 22° C. | Over 93° C. | Over 93° C. |
| Cloud Point (1% Solution in 10% NaCl) | — | 87° C. | 74° C. |

EXAMPLE III

In this example, a series of ethylene oxide adducts of a long chain glucoside material is prepared at various levels of ethylene oxide substitution. The non-ethyoxylated long chain glucoside starting material employed is one in which the long chain alkyl group is a mixture of $C_{12}$ and $C_{13}$ alkyl groups and which comprises, on a total $C_{12-13}$ glucoside weight basis, about 65 weight percent of the $C_{12-13}$ alkyl monoglucoside species and about 35 weight percent of $C_{12-13}$ alkyl polyglucoside constituents, the average D.P. of these latter constituents being less than 2.7. The overall average D.P. of such starting materials is approximately 1.3 to 1.4. This first long chain glucoside material is hereinafter referred to as the "Low D.P. Sample".

The ethoxylation reaction itself is conducted generally in accordance with the procedure of Example 1 above.

For comparative purposes, a second $C_{12-13}$ alkyl glucoside starting material is similarly ethoxylated at various levels of ethylene oxide substitution. This latter glucoside starting material comprises, on a total $C_{12-13}$ glucoside weight basis, about 45 to 50 weight percent of the $C_{12-13}$ alkyl monoglucoside species and about 50 to 55 weight percent of $C_{12-13}$ alkyl polyglucoside constituents. The average D.P. of the $C_{12-13}$ alkyl polyglucoside constituents is greater than 2.7. This second long chain glucoside material is hereinafter referred to as the "High D.P. Sample".

The various ethylene oxide adducts of the two different $C_{12-13}$ alkyl glucoside starting materials and the starting materials themselves are evaluated as to their wetting properties via Draves Sink Time testing. The results of such testing are summarized in Table II below.

TABLE II

| | DRAVES SINK TIME (SECONDS) | | | |
|---|---|---|---|---|
| | Moles Ethylene Oxide/Mole of Anhydroglucose Unit | | | |
| | NONE | 1 | 2.5 | 5 |
| Low D.P. Sample | 38 | 15 | 18 | 50 |
| High D.P. Sample | 28 | 22 | 27 | 100 |

As can be seen from the results in Table II, ethoxylation (particularly at levels of 1 and 2.5 moles of ethylene oxide per mole of anhydroglucose unit) of the relatively low (i.e., 1.3–1.4) D.P., relatively high (i.e., about 65 weight percent) monoglucoside content $C_{12-13}$ glucoside composition results in a very dramatic reduction in the wetting time thereof. Surprisingly, such ethoxylated low D.P. products are faster wetting materials than the corresponding ethoxylated higher D.P. counterpart.

The various ethylene oxide adducts and their respective starting materials are also evaluated for foaming capability via Ross Miles Foam Height testing. The results of such evaluations are shown in Table III below.

TABLE III

| | ROSS MILES FOAM HEIGHT (MILLMETERS) | | | |
|---|---|---|---|---|
| | Moles Ethylene Oxide/Mole of Anhydroglucose Unit | | | |
| | NONE | 1 | 2.5 | 5 |
| Low D.P. Sample | 25 | 85 | 90 | 110 |
| High D.P. Sample | 70 | 90 | 88 | 90 |

As can be seen, ethoxylation dramatically enhances the foaming capability of the relatively low D.P. $C_{12-13}$ alkyl glucoside composition. Moreover, it can also be seen that ethoxylation of such material at levels in excess of 2.5 moles of ethylene oxide per mole of anhydroglucose unit results in larger foam heights than are obtained at comparable degrees of ethoxylation in the case of the higher D.P. $C_{12-13}$ glucoside composition.

These ethylene oxide adducts and their respective starting materials are also evaluated in Tergotometer testing for laundry cleaning effectiveness using dust sebum soiled cloth in test formulations containing 30 weight percent of the surfactant candidate of interest and 70 weight percent water. Test conditions employed are 1 g detergent formulation per liter of wash water; 120 ppm water hardness and 100° F. wash temperature.

The laundry cleaning effectiveness results are summarized in Table IV below. (In such Table, the cleaning results are stated as a percentage of that provided by the non-ethoxylated, relatively high D.P. starting material taken as a standard.)

TABLE IV

| | LAUNDRY CLEANING EFFECTIVENESS | | | |
|---|---|---|---|---|
| | Moles Ethylene Oxide/Mole of Anhydroglucose Unit | | | |
| | NONE | 1 | 2.5 | 5 |
| Low D.P. Sample | 90 | 115 | 126 | 125 |
| High D.P. Sample | 100 | 120 | 127 | 122 |

While the relatively low D.P. non-ethoxylated starting material exhibits notably less cleaning effectiveness than the corresponding non-ethoxylated higher D.P. counterpart, such cleaning effectiveness differences virtually disappear upon ethoxylation of the subject long chain glucoside compositions.

The above described low D.P. and high D.P. ethylene oxide adducts are also evaluated for laundry cleaning effectiveness in detergent formulations employing such adducts in a 1:1 weight ratio combination with an ethoxylated $C_{12-13}$ fatty alcohol nonionic surfactant (7 moles of ethylene oxide per mole of fatty alcohol). The formulations employing the ethoxylated low D.P. materials exhibit cleaning performance at least as good as those based upon their ethoxylated relatively higher D.P. counterparts.

While the subject matter hereof has been described and illustrated by reference to particular examples and embodiments thereof, such is not to be construed as in any way limiting the scope of the instantly claimed invention.

What is claimed is:

1. An oxyalkylated long chain glycoside compositon which comprises, on a total oxyalkylated long chain glycoside weight basis:

(a) from about 55 to 95 weight percent of an oxyalkylated long chain monoglycoside of the formula:

$$R—O—G\ (AO)_mH \qquad A;$$

and (b) from 5 to about 45 weight percent of an oxyalkylated long chain polyglycoside of the formula:

$$R—O(G)_x(AO)_nH \qquad B$$

wherein R is a monovalent hydrocarbon radical containing from about 6 to about 20 carbon atoms; G is a moiety derived from a reducing saccharide containing 5 or 6 carbon atoms; AO is an alkylene oxide residue; m represents the degree of alkylene oxide substitution on the oxyalkylated long chain monoglycoside and has an average value of from 1 to about 5; n represents the degree of alkylene oxide substitution on the oxyalkylated long chain polyglycoside and has an average value of from 1 to about 15; x represents the number of monosaccharide repeating units in the oxyalkylated long chain polyglycoside, is an integer of 2 or greater on a molecule by molecule basis and has an average value of less than 2.7 and wherein said oxyalkylated long chain glycoside composition contains an average of from 1 to 4 moles of alkylene oxide substitution per mole of monosaccharide units within the oxyalkylated long chain mono- and polyglycoside constituents within said composition.

2. The composition of claim 1 wherein, on a total oxyalkylated long chain glycoside weight basis, the formula A monoglycoside species constitutes from about 60 to about 90 weight percent and the formula B polyglycoside species constitutes from about 10 to about 40 weight percent.

3. The composition of claim 1 wherein the overall average degree of polymerization for all oxyalkylated long chain glycoside species taken in combination is less than 1.6.

4. The composition of claim 1 wherein G is a moiety derived from glucose.

5. The composition of claim 4 wherein R is an alkyl group containing from about 8 to about 18 carbon atoms.

6. The composition of claim 1 wherein the alkylene oxide residue, AO, is ethylene oxide, propylene oxide or mixtures thereof.

7. The composition of claim 1 wherein the alkylene oxide residue is ethylene oxide.

8. The composition of claim 1 wherein x has an average value of less than 2.4.

9. The composition of claim 1 wherein x has an average value of less than 2.6.

10. The composition of claim 1 wherein x has an average value of less than 2.5.

11. A formulated detergent composition comprising, on a total composition weight basis:

(a) from about 1 to about 90 weight percent of an oxyalkylated long chain glycoside composition which comprises on a total oxyalkylated long chain glycoside weight basis:

(1) from about 55 to 95 weight percent of an oxyalkylated long chain monoglycoside of the formula:

$$R—O—G\ (AO)_mH \qquad A;$$

and (2) about 5 to about 45 weight percent of an oxyalkylated long chain polyglycoside of the formula:

$$R—O\ (G)_x(AO)_nH \qquad B$$

wherein R is a monovalent hydrocarbon radical containing from about 6 to about 20 carbon atoms; G is a moiety derived from a reducing saccharide containing 5 or 6 carbon atoms; AO is an alkylene oxide residue; m represents the degree of alkylene oxide substitution on the oxyalkylated long chain monoglycoside and has an average value of from about 1 to about 5; n represents the degree of alkylene oxide substitution on the oxyalkylated long chain polyglycoside and has an average value of from about 1 to about 15; x represents the number of monosaccharide repeating units in the oxyalkylated long chain polyglycoside, is an integer of 2 or greater on a molecule by molecule basis and has an average value of less than 2.7 and wherein said oxyalkylated long chain glycoside composition contains an average of from 1 to 4 moles of alkylene oxide per mole of monosaccharide units within the oxyalkylated long chain mono- and polyglycoside constituents within said oxyalkylated long chain glycoside composition;

(b) from about 1 to about 90 weight percent of an anionic, cationic or nonionic cosurfactant ingredient; and (c) up to about 98 weight percent water.

12. The formulated detergent composition of claim 11 which further comprises, on a total composition weight basis, from about 1 to about 90 weight percent of a water soluble detergent builder ingredient.

13. The formulated detergent composition of claim 11 wherein R is a $C_8$–$C_{18}$ alkyl group; G is a moiety derived from glucose; and x has an average value of less than 2.5.

14. The formulated detergent composition of claim 13 wherein, on a total oxyalkylated long chain glycoside weight basis, the formula A monoglycoside species constitutes from about 60 to about 90 weight percent and the formula B polyglycoside species constitute from about 10 to about 40 weight percent.

15. The formulated detergent composition of claim 14 wherein the alkylene oxide residue, AO, is ethylene oxide.

16. A formulated detergent composition comprising, on a total composition weight basis:

(a) from about 1 to about 90 weight percent of an oxyalkylated long chain glycoside composition which comprises, on a total oxyalkylated long chain glycoside weight basis:

(1) from about 55 to 95 weight percent of an oxyalkylated long chain monoglycoside of the formula:

$$R—O—G\ (AO)_mH \qquad A;$$

and (2) from 5 to about 45 weight percent of an oxyalkylated long chain polyglycoside of the formula:

$$R—O\ (G)_x(AO)_nH \qquad B$$

wherein R is a monovalent hydrocarbon radical containing from about 6 to about 20 carbon atoms; G is a moiety derived from a reducing saccharide containing 5 or 6 carbon atoms; AO is an alkylene oxide residue, m represents the degree of alkylene oxide substitution on the oxyalkylated long chain monoglycoside and has an average value of from about 1 to about 5; n represents the degree of alkylene oxide substitution on the oxyalkylated long chain polyglycoside and has an average value of from about 1 to about 15; x represents the number of monosaccharide repeating units in the oxyalkylated long chain polyglycoside, is an integer of 2 or greater on a molecule by molecule basis and has an average value of less than 2.7 and wherein the average values of m and n above are such that the oxyalkylated long chain glycoside composition contains an average of from 1 to 4 moles of alkylene oxide per mole of reducing saccharide moiety, G, contained within the oxyalkylated long chain mono- and polyglycoside constituents within said composition;

(b) from about 1 to about 90 weight percent of a water soluble builder ingredient; and (c) up to about 98 weight percent water.

17. The formulated detergent composition of claim 16 wherein R is a $C_{8-18}$ alkyl group; G is a moiety derived from glucose; and x has an average value of less than 2.5.

18. The formulated detergent composition of claim 17 wherein the alkylene oxide residue, AO, is ethylene oxide.

19. The formulated detergent composition of claim 18 wherein, on a total oxyalkylated long chain glycoside weight basis, the formula A monoglycoside species constitutes from about 60 to about 90 weight percent and the formula B polyglycoside species constitute from about 10 to about 40 weight percent.

20. The formulated detergent composition of claim 18 wherein the overall average degree of polymerization for all oxyalkylated long chain glycoside species in the composition taken in combination is less than 1.6.

21. The composition of claim 1 wherein the oxyalkylated long chain glycoside composition comprises an average of from about 1 to about 3 moles of alkylene oxide substitution per mole of monosaccharide units within the oxyalkylated long chain mono- and polyglycoside constituents of said composition.

22. The composition of claim 1 wherein the oxyalkylated long chain glycoside composition comprises an average of from about 1 to about 3.5 moles of alkylene oxide substitution per mole of monosaccharide units within the oxyalkylated long chain mono- and polyglycoside constituents of said composition.

23. The composition of claim 11 wherein the oxyalkylated long chain glycoside composition comprises an average of from about 1 to about 3 moles of alkylene oxide substitution per mole of monosaccharide units within the oxyalkylated long chain mono- and polyglycoside constituents of said composition.

24. The composition of claim 11 wherein the oxyalkylated long chain glycoside composition comprises an average of from about 1 to about 3.5 moles of alkylene oxide substitution per mole of monosaccharide units within the oxyalkylated long chain mono- and polyglycoside constituents of said composition.

25. The composition of claim 16 wherein the oxyalkylated long chain glycoside composition comprises an average of from about 1 to about 3 moles of alkylene oxide substitution per mole of monosaccharide units within the oxyalkylated long chain mono- and polyglycoside constituents of said composition.

26. The composition of claim 16 wherein the oxyalkylated long chain glycoside composition comprises an average of from about 1 to about 3.5 moles of alkylene oxide substitution per mole of monosaccharide units within the oxyalkylated long chain mono- and polyglycoside constituents of said composition.

27. The composition of claim 1 wherein x has an average value of less than 2.5 and wherein the oxyalkylated long chain glycoside composition comprises an average of from about 1 to about 3.5 moles of alkylene oxide substitution per mole of monosaccharide units within the oxyalkylated long chain mono- and polyglycoside constituents of said composition.

28. The composition of claim 1 wherein x has an average value of less than 2.5 and wherein the oxyalkylated long chain glycoside composition comprises an average of from about 1 to about 3 moles of alkylene oxide substitution per mole of monosaccharide units within the oxyalkylated long chain mono- and polyglycoside constituents of said composition.

29. The composition of claim 1 wherein x has an average value of less than 2.4 and wherein the oxyalkylated long chain glycoside composition comprises an average of from about 1 to about 3.5 moles of alkylene oxide substitution per mole of monosaccharide units within the oxyalkylated long chain mono- and polyglycoside constituents of said composition.

30. The composition of claim 1 wherein x has an average value of less than 2.4 and wherein the oxyalkylated long chain glycoside composition comprises an average of from about 1 to about 3 moles of alkylene oxide substitution per mole of monosaccharide units within the oxyalkylated long chain mono- and polyglycoside constituents of said composition.

31. The composition of claim 1 wherein the monovalent hydrocarbon group, R, contains from about 1 to about 18 carbon atoms.

32. The composition of claim 11 wherein the monovalent hydrocarbon group, R, contains from about 10 to about 18 carbon atoms.

33. The composition of claim 16 wherein the monovalent hydrocarbon group, R, contains from about 10 to about 18 carbon atoms.

* * * * *

UNITED STATES PATENT AND TRADEMARK OFFICE

CERTIFICATE OF CORRECTION

PATENT NO. : 4,834,903

DATED : May 30, 1989

INVENTOR(S) : C. Roth, G. Howell, K. Moser, A. Urfer

It is certified that error appears in the above-identified patent and that said Letters Patent is hereby corrected as shown below:

In claim 1, at Column 11, line 7, after "from" add --about--.

In claim 16, at Column 12, line 65, after "from" add --about--.

Signed and Sealed this

Tenth Day of December, 1991

*Attest:*

HARRY F. MANBECK, JR.

*Attesting Officer*

*Commissioner of Patents and Trademarks*